United States Patent [19]

Ganz

[11] 3,981,120

[45] Sept. 21, 1976

[54] BOTTLE PACKAGING MACHINE

[75] Inventor: Robert H. Ganz, Saddle River, N.J.

[73] Assignee: Federal Paper Board Company, Inc., Montvale, N.J.

[22] Filed: Sept. 16, 1974

[21] Appl. No.: 506,098

Related U.S. Application Data

[63] Continuation-in-part of Ser. No. 470,036, May 15, 1974, Pat. No. 3,940,907.

[52] U.S. Cl. ..... 53/48

[51] Int. Cl.² ..... B65B 21/08

[58] Field of Search ..... 53/48, 183, 196

[56] References Cited

UNITED STATES PATENTS

| | | | |
|---|---|---|---|
| 2,817,196 | 12/1957 | Ringler | 53/48 X |
| 2,998,685 | 9/1961 | Ganz | 53/48 X |
| 3,182,431 | 5/1965 | Ganz | 53/48 X |
| 3,197,937 | 8/1965 | Ganz | 53/48 |

*Primary Examiner*—Leon Gilden

*Attorney, Agent, or Firm*—Guy A. Greenawalt

[57] ABSTRACT

An apparatus for automatically closing the end panels or flaps of cartons or carriers of the type which are in the form of a tube disposed over an assembly of bottles or the like, specifically, bottom loaded beverage bottle carriers or cartons, in which there is a conveyor means for advancing the carton and bottle assemblies along a path between oppositely disposed runs of horizontally disposed, traveling conveyors having panel engaging fingers which co-operate with associated plow members in closing the top end panels and in holding the same in properly aligned and closed position while overlapped margins are locked together by interengaging latching and locking elements thereon, together with fixed plow type members disposed along the path of advance of the assemblies for closing bottom wall forming panels and interengaging latching and locking elements on these panels so as to lock the same in bottom wall forming position.

17 Claims, 18 Drawing Figures

FIG. 4
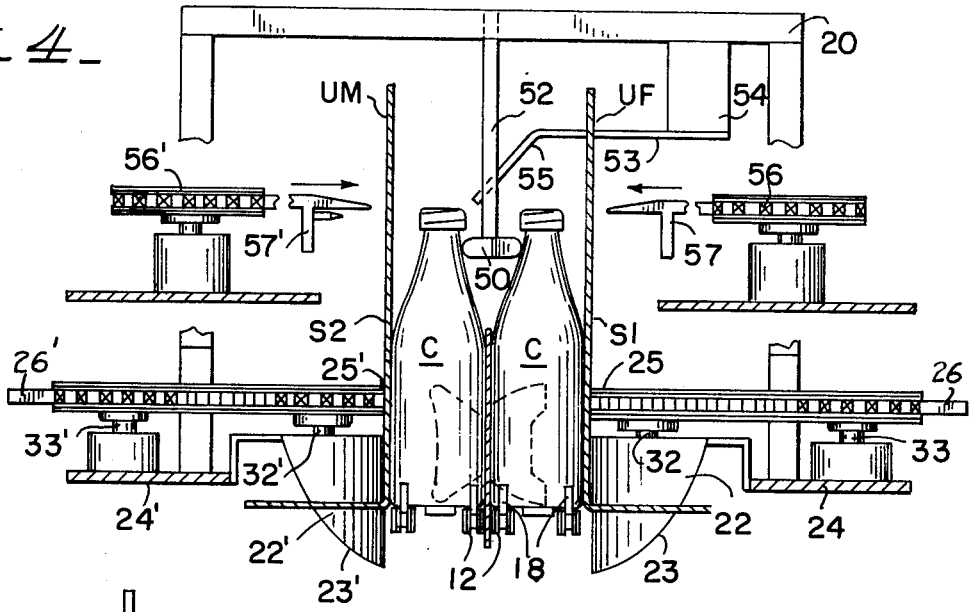
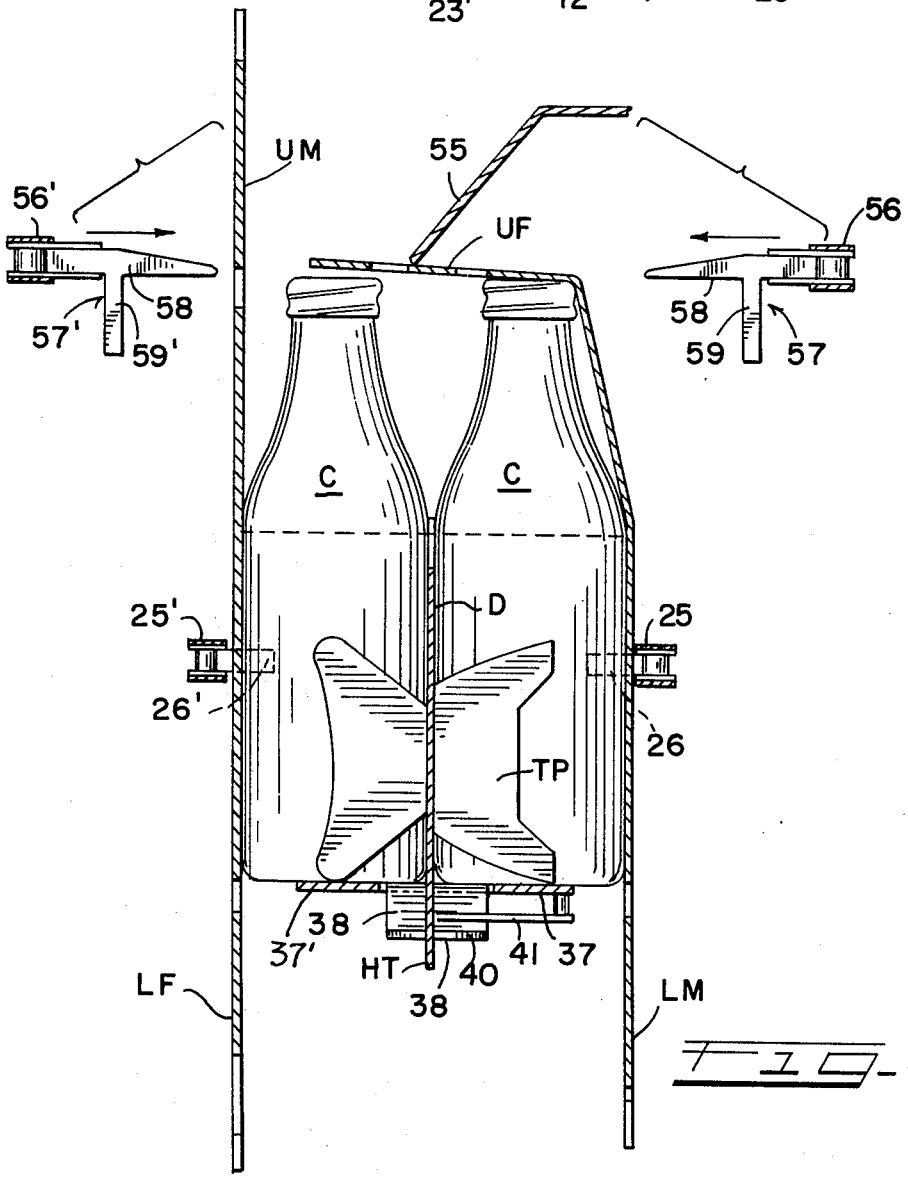
FIG. 5

FIG. 6
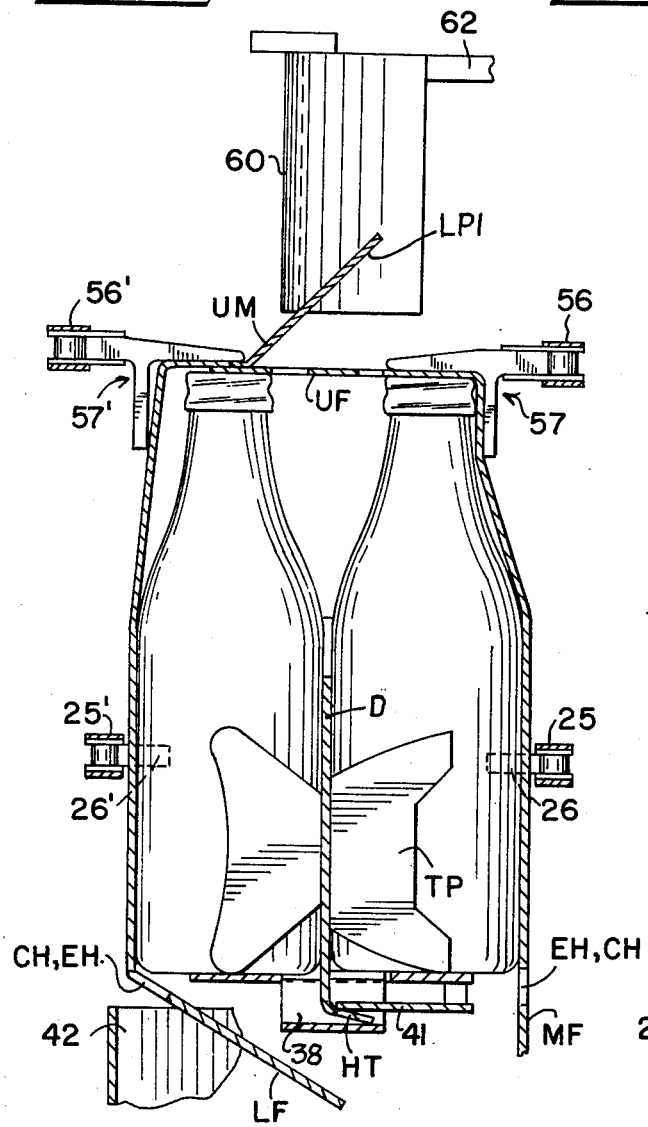
FIG. 9
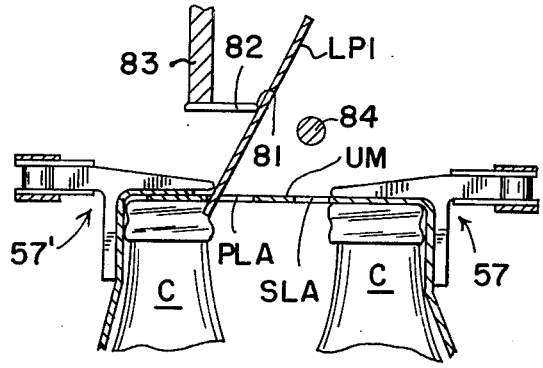
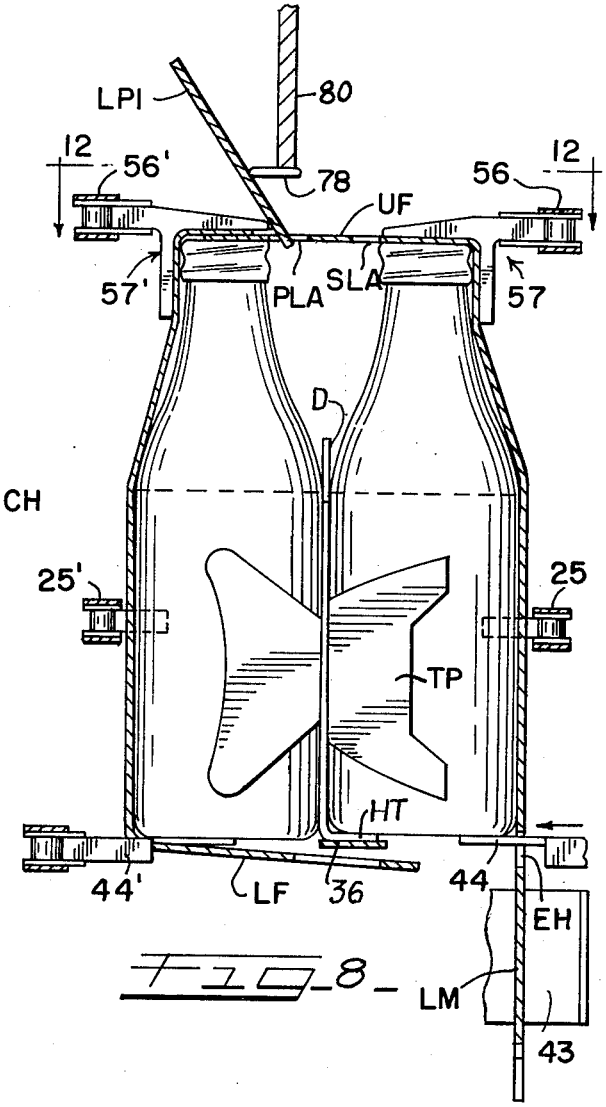
FIG. 8
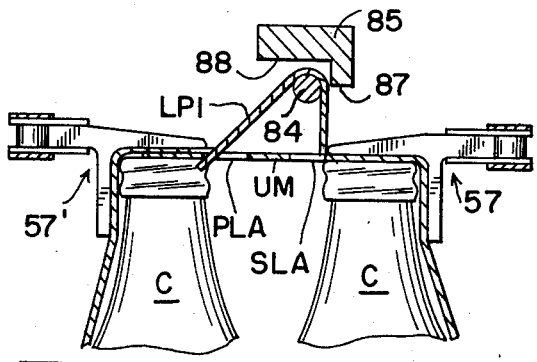
FIG. 10
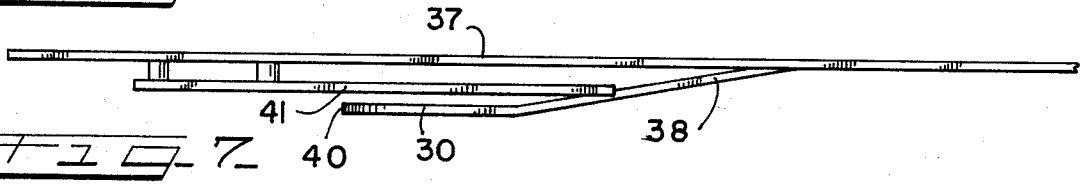
FIG. 7

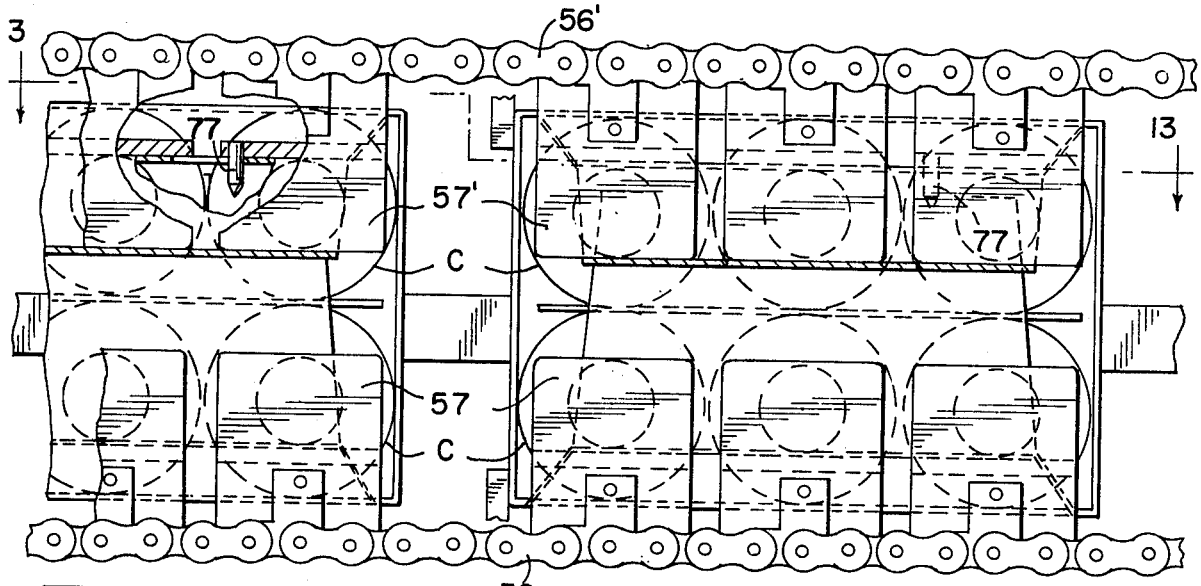
FIG. 12
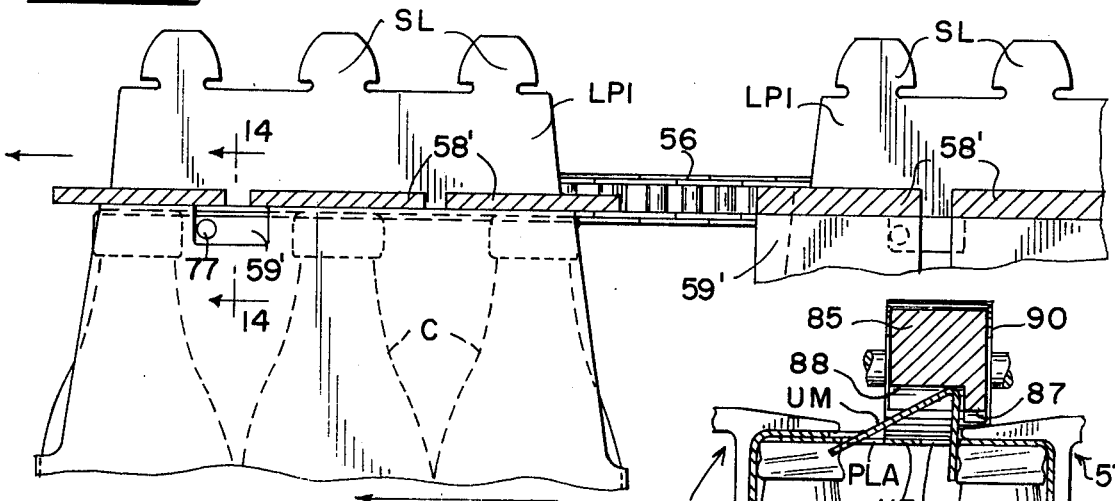
FIG. 13
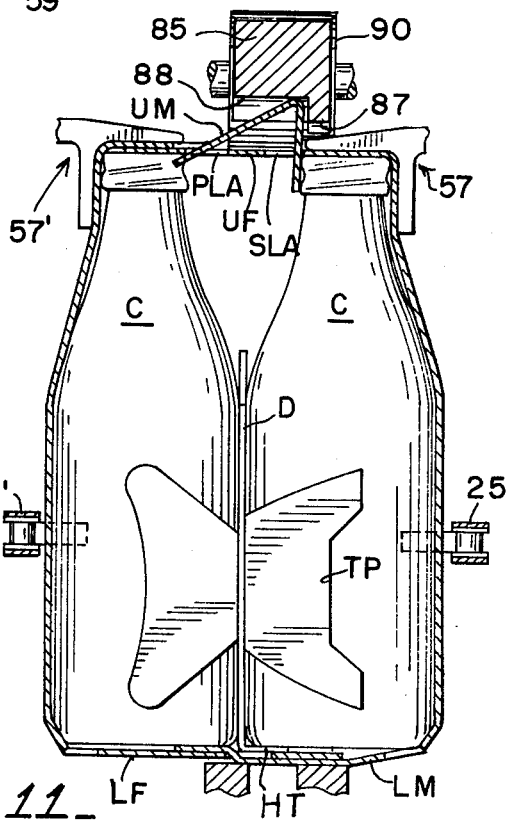
FIG. 11
FIG. 14
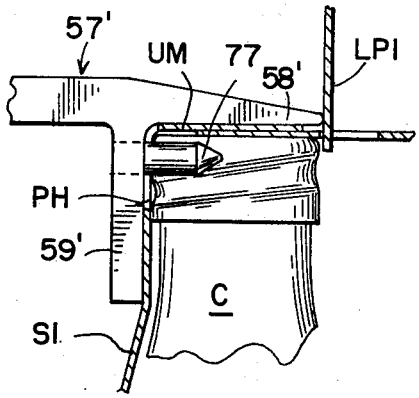

BOTTLE PACKAGING MACHINE

This application is a continuation-in-part of application Ser. No. 470,036, filed May 15, 1974 now patent No. 3,940,907.

This invention relates to packaging machinery or apparatus and is more particularly concerned with improvements in apparatus for closing and securing wall forming panels, on at least one end of the carriers or cartons, when they have been filled with beverage bottles, or similar articles, the carriers being of the type which are initially formed as a collapsed tube with at least one end open and with wall forming closure panels extended in the plane of the collapsed tube and having at their free margins locking and latching elements which are adapted for interlocking engagement when the cartons or carriers are set up and the panels are swung to closed position.

In the marketing of products such as bottled and canned beverages and the like, many different packaging arrangements have been employed. Generally, each new packaging design has resulted in the development of new machinery for handling the packaging operations. Two general types of packages have proven most acceptable to the beverage bottling and canning industry, both of which are adapted to contain a multiplicity of the product elements, usually six, eight or twelve bottles or cans. In one form of package, used most often for canned beverages, an elongate rectangular blank, which is especially cut and scored, is wrapped about an assembly of cans or bottles and its end secured so as to tightly enclose the assembly. Another type of package which is used for bottled beverages employs a carton which is in the form of a cellular basket with an open top and having a collapsed cell-forming partition structure which is opened up to receive the bottles when the initially collapsed carrier is set up. Heretofore, this type carrier has been designed with an initially closed bottom and the carrier has been fabricated for loading from the top, that is, the cartons or carriers are set up and the bottles are dropped into the cells through the open top. This involves handling of the bottles in a manner which is undesirable. More recently there has been developed a package for this purpose which employs a carton having some of the characteristics of both the basket type and the wrap-around type and which is fabricated in collapsed or flattened condition with bottom wall forming panels initially extended in the plane of the side walls and enabling the container to be opened into tubular form and dropped over an assembly of bottles after which the bottom wall panels, and in some designs also the top wall panels, are folded to closed position and connected by interengaging locking and latching elements. A carton design of the latter type is disclosed in the application of Edwin L. Arneson and Guelfo A. Manizza, Ser. No. 368,825, filed June 11, 1973. It is a general object of the present invention to provide apparatus which is particularly adapted for use in packaging with a carton or carrier of this general type so as to close and latch the panels forming the top and bottom walls of the package upon the carton being opened up and dropped over an assembly of bottles which apparatus will operate efficiently at a relatively high rate of spped so as to be adapted for use in high speed beverage bottling, canning and packaging lines.

It is a more specific object of the invention to provide an apparatus for automatically closing and locking wall forming closure panels on bottle carriers or cartons of the tubular type which are adapted to be opened, filled or loaded with groups or assemblies of bottles and thereafter advanced through the apparatus so as to effect the closing by folding and latching the wall forming panels.

It is another object of the invention to provide an apparatus for use in packaging bottles or the like in bottle carriers or cartons which are of the type which are initially formed in collapsed tubular condition with top and bottom wall forming closure panels extending in the plane of the side wall panels so that they may be opened up, filled with bottles and the top and bottom walls closed, the apparatus comprising conveyor means for advancing the carton and bottle assemblies between confronting runs of traveling conveyor carried panel engaging members which hold the closure panels in aligned wall forming relation while latching and/or locking elements are engaged to lock the panels in wall forming relation.

These and other objects of the invention will be apparent from a consideration of the carrier or carton opening and loading apparatus which is shown by way of illustration in the accompanying drawings wherein:

FIG. 4 is a cross sectional view taken on the line 4—4 of FIG. 2;

FIG. 5 is a cross sectional view taken on the line 5—5 of FIG. 3, to an enlarged scale;

FIG. 6 is a fragmentary cross sectional view taken on the line 6—6 of FIG. 3, to an enlarged scale;

FIG. 7 is a fragmentary elevational view taken on the line 7—7 of FIG. 6;

FIG. 8 is a cross sectional view taken on the line 8—8 of FIG. 3, to an enlarged scale;

FIG. 9 is a fragmentary cross sectional view taken on the line 9—9 of FIG. 2, to an enlarged scale;

FIG. 10 is a fragmentary cross sectional view taken on the line 10—10 of FIG. 2, to an enlarged scale;

FIG. 11 is a cross sectional view taken on the line 11—11 of FIG. 2, to an enlarged scale;

FIG. 12 is a fragmentary view taken on the horizontal plane indicated by the lines 12—12 on FIG. 8, with portions broken away;

FIG. 13 is a fragmentary vertical section taken on the line 13—13 of FIG. 12;

FIG. 14 is a fragmentary cross sectional view taken on the line 14—14 of FIG. 13, to an enlarged scale;

Figure 15:
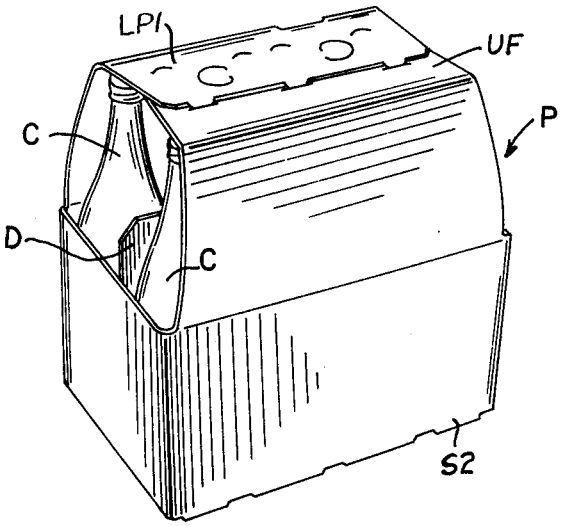
FIG. 15 is a perspective view showing the completed package which is adapted to be formed on the illustrated machine.
Figure 16:
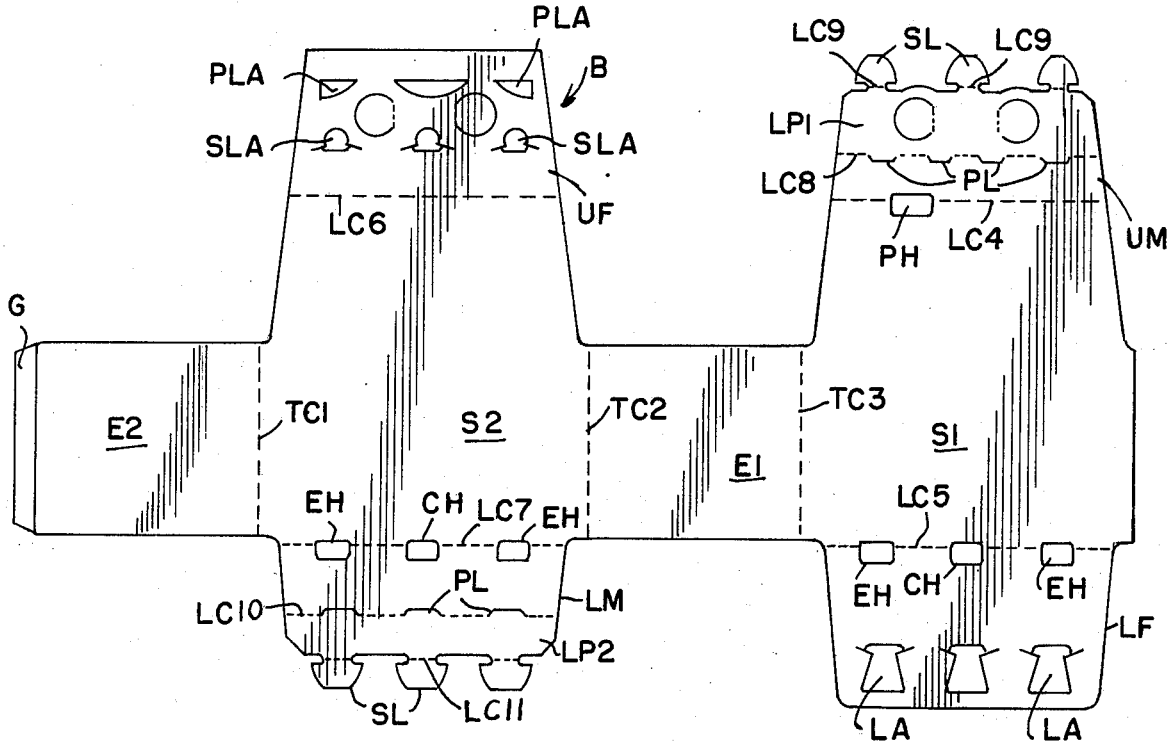
FIG. 16 is a plan view of the blank which is cut and scored to provide the carton in the package of FIG. 15.

Referring to FIG. 15, there is illustrated a bottle carrier package P which is adapted to be formed by enclosing a group or assembly of beverage bottles or other product elements of similar character in a carton or carrier which is fabricated from a blank B of paperboard or other suitable package forming sheet material, cut and scored as shown in FIG. 16. While the blank B is illustrated as specially designed for use in a machine which includes the present end flap closing and locking apparatus, it has the basic construction shown in application Ser. No. 368,825.

The blank is divided by transverse score lines TC1, TC2 and TC3, which are spaced lengthwise of the blank, into side wall forming panel sections S1 and S2 and end wall forming panels E1 and E2. The side wall panel section S1 has lateral extensions divided therefrom by transversely spaced, longitudinal crease lines LC4 and LC5 which extensions constitute an upper, top wall forming male panel UM, and a lower, bottom wall forming, female panel LF. The side wall forming panel section S2 has lateral extensions of a similar character which are divided therefrom by transversely spaced, longitudinal crease lines LC6 and LC7, which extensions panels constitute upper or top wall forming female panel UF and lower, bottom wall forming male panel LM. The upper male panel UM includes a latching panel LP1 which is adapted to hinge on the longitudinal crease or score lines LC8 and which includes primary locking or latching elements or tabs PL spaced along the hinge line LC8 and secondary locking or latching elements in the form of fingers SL spaced along the free margin of the panel UM and adapted to hinge on the line LC9 at the base thereof. In like manner lower male panel LM includes a corresponding latching panel LP2 which is adapted to hinge on the longitudinal crease or score line LC10 and having locking and latching elements PL and SL with the latter adapted to hinge on the line LC11. Locking apertures LA for cooperating with the locking panel LP2 are provided in the panel LF and locking apertures PLA and SLA are provided in panel UF for cooperation with the locking panel LP1. The fingers, tabs and apertures constitute co-operating locking and latching elements for securing the panels in tight engagement. A series of spaced heel holes for the bottles are provided, at one side of the blank, along each of the longitudinal crease lines LC5 and LC7 which are designated CH for the center hole and EH for each of the end holes. Along the opposite side of the blank, the side wall panel section S1 has a relatively small, elongated rectangular hole or aperture PH cut therein at the top edge forming crease line LC4, for co-operation with a conveyor carried pin or lug, in squaring up the carton, as hereinafter described. Except for the hole PH, the blank B may be cut and scored according to the description of the blank in Ser. No. 368,825.

Figure 17:
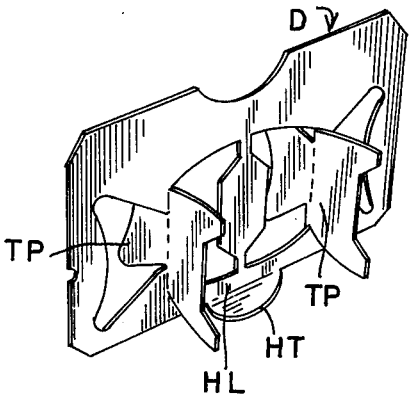
FIG. 17 is a perspective view of a longitudinal and transverse partition element for separating the bottles in the package.
Figure 18:
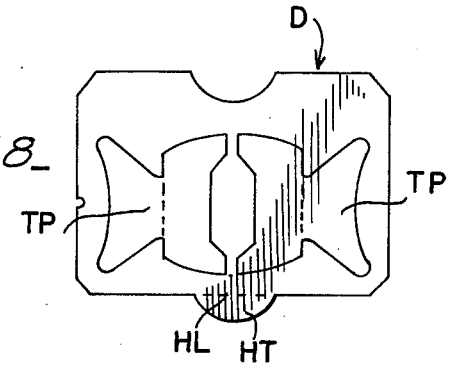
FIG. 18 is a plan view of the blank which is cut and scored to form the partition elements of FIG. 17.

The illustrated carrier or carton is adapted to be fabricated at the manufacturing plant, for delivery to the bottling plant, in collapsed or flattened condition, by folding blank B on the score or crease lines TC1 and TC3, with the panel section S1 and E2 being connected by the glue tab or glue panel G at the one end of the blank. The bottle separator or partition forming panel structure D (FIGS. 17 and 18) may be formed in accordance with the disclosure in application Ser. No. 368,825. In the form illustrated, it comprises a generally rectangular, elongated panel, the main portion of which is designed to form a longitudinal partition between the two rows of bottles C in finished package P. It is provided with two spaced, transverse partition forming panels TP, which are cut so that they are adapted to hinge into transverse planes on spaced, transverse score lines in order to form transverse partitions for separating the center bottles in the two rows from the end bottles therein. In addition, the separating panel D has a tab HT along the bottom forming edge thereof which is adapted to be bent over into a horizontal, transverse plane on a hinge forming crease or score line HL at the edge of the panel. The tab HT is disposed in the final package P (FIG. 11) beneath the center bottle C which serves to hold the partition panel D in proper vertical position between the bottles, the height of the panel being substantially less than the height of the bottles, the tab HT serving to anchor the panel in its bottle separating position.

Figures 1, 2, 3:
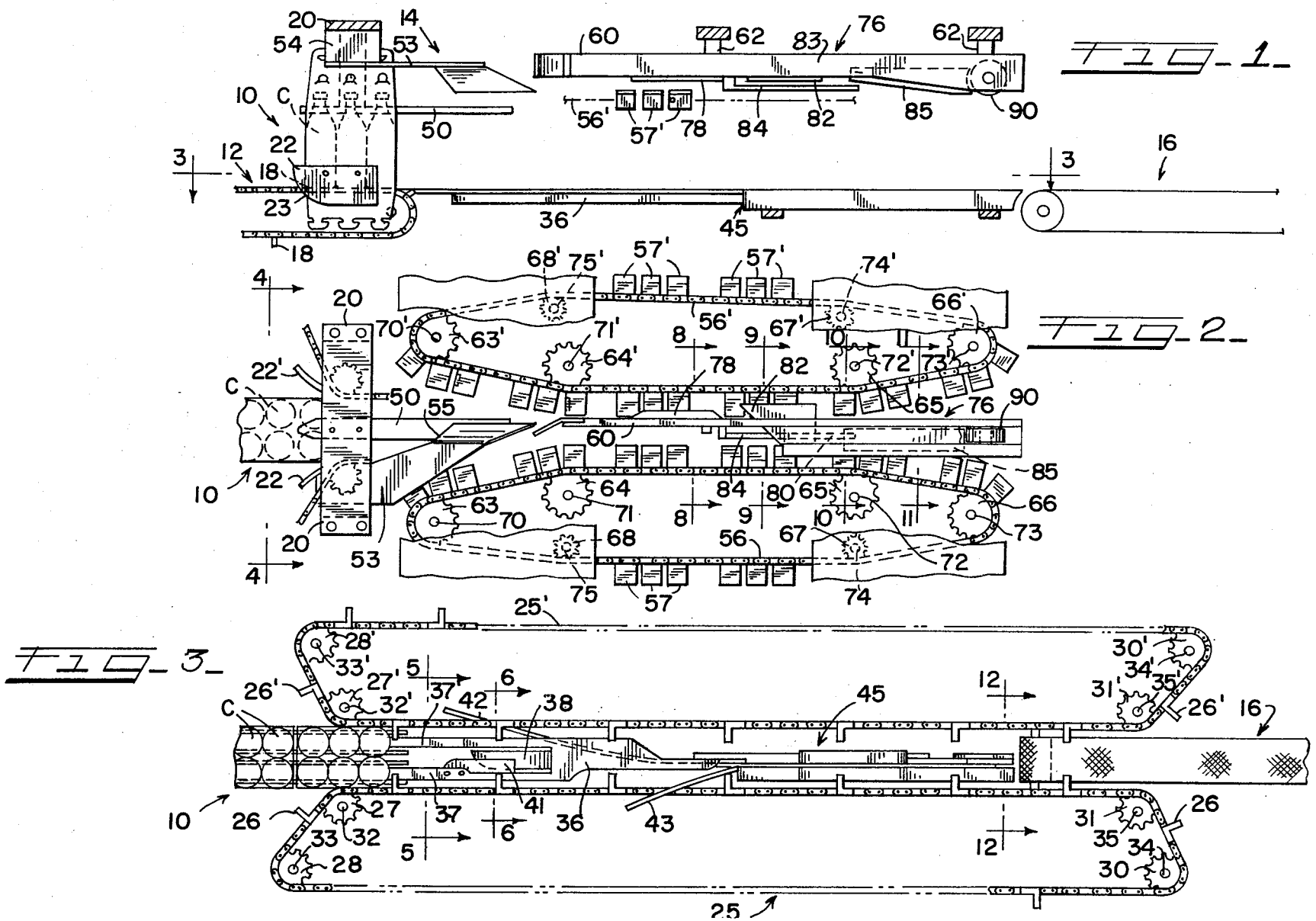
FIG. 1 is a side elevation of an apparatus embodying the principal features of the invention, the view being in part schematic and having parts thereof omitted or broken away.
FIG. 2 is a plan view of the apparatus, with portions omitted and other portions broken away.
FIG. 3 is a view taken on the horizontal plane indicated at 3—3 on FIG. 1 with portions broken away.

Referring to FIGS. 1 to 3, particularly, there is illustrated an apparatus embodying the principles of the present invention which is adapted to be employed in forming the package shown in FIG. 15 which comprises a group of six bottles C arranged in double row, transversely aligned pairs, and enclosed in a carton formed from the blank B. The initially collapsed carriers are first opened into squared-up or tubular condition, with top and bottom wall forming panels extended in the planes of the side walls to which they are hinged. The squared-up cartons are advanced to a point where each successive carton is dropped onto an assembly of bottles advanced on a conveyor beneath the mechanism for feeding the cartons. Thereafter, the assemblies are advanced through the present apparatus for closing and latching the top and bottom wall forming panels with the partition forming member D being dropped between the bottle assemblies before they reach the point where the carton is lowered onto the same.

As illustrated in FIGS. 1 to 3, the present apparatus comprises an infeed section 10 at the entrance end thereof which includes a bottle feed line conveyor mechanism 12 for advancing the bottles C in a double line so as to receive an opened carton on groups comprising two rows of three bottles each, which are aligned transversely in pairs and which are advancing on the conveyor mechanism 12. A suitable mechanism (not shown) is provided for inserting a partition member D between the bottles of each group at some point prior to advance of the groups of bottles to the station where the carton is assembled with the bottles. Following the deposit of the cartons onto the bottle assemblies, the conveyor mechanism 12 advances the carton and bottle assemblies through the mechanism 14 which closes the top and bottom wall panels UM, UF and LM, LF and locks the same. A package discharge conveyor 16 at the discharge or exit end of the apparatus is provided to receive the completed packages.

It will be understood that in the drawings illustrating the preferred form of the apparatus, the structural frame on which the various elements are mounted has been omitted or broken away, only parts being shown where it is considered to be helpful in understanding the arrangement of the elements and the operation thereof. Also, there are moving elements employed in the apparatus requiring connection to a suitable power drive which does not appear to require detailed illustration.

As the cartons and bottle assemblies are advanced on the conveyor 12 by the lugs 18 they move beneath a cross frame 20 of inverted U shape at the end of conveyor 12, only the leading end portion of the latter being shown. Plow members (FIGS. 1, 2, 3 and 4), in the form of plates 22 and 22′, with curved entrance edges 23 and 23′ are mounted on the cross frame 20 near the bottom thereof which are positioned relative to the path of the bottom wall forming panels LM and LF so as to turn or guide these panels into downwardly directed vertical planes below the associated side wall panels S2 and S1 as shown in FIG. 5. The plow or guide plate members 22 and 22′ are supported by means of laterally extending bracket members 24 and 24′ on the cross frame 20.

The brackets 24 and 24′ (FIG. 4) are extended so as to support the entrance ends of laterally spaced conveyor chains 25 and 25′ which are mounted for movement in a common horizontal plane and which have lug members 26, 26′ spaced thereon for co-operation in advancing the carton and bottle assemblies along a path between transversely spaced, opposed runs of the chains 25 and 25′. The conveyor chains 25 and 25′ are supported in an identical manner on opposite sides of the carton path, as indicated in FIG. 3. The chain 25 is supported on four sprockets 27, 28, 30, 31, which sprockets are mounted on parallel, vertically disposed shafts 32, 33, 34, 35. The shafts 32 and 33 at the entrance end thereof are supported on the bracket member 24. The chain 25′ is supported in the same manner on the opposite side of the path of the assemblies on the sprockets 27′, 28′, 30′, 31′ which are mounted on shafts 32′, 33′, 34′, 35′, with the shafts 32′, 33′ at the entrance end being supported on the bracket member 24, so as to provide parallel spaced runs between which the carton assembly is advanced. The chains 25, 25′ are driven by connection with a suitable power drive (not shown), and take over the advance of the carton and bottle assemblies from the conveyor 12 which terminates at the cross frame 20. As the advance of successive carton and bottle assemblies is taken over by the side conveyors 25, 25′ the assemblies are supported on a bottom plate 36 (FIG. 3) which is bifurcated at the entrance end, providing clearance between laterally spaced legs 37, 37′ (FIGS. 2 and 4) for travel of the center chains of the conveyor 12. A tongue member 38 (FIGS. 2, 5 and 6) extends down between the legs 37 and 37′ of the support plate 36 with a curved entrance edge 40 for engaging the holddown tab HT on the divider panel D which is positioned between the two rows of bottles and has settled to the bottom by gravity (FIG. 5). A horizontally disposed plate 41 is mounted in spaced relation beneath the one leg 37 of the support plate 36 with an inner edge positioned so as to strike the partition panel D on the hinge line HL and hold the body of the panel against bending while permitting the holddown tab HT to ride forward on the edge 40 of the tongue 38 so as to break the hinge crease and swing tab HT to the position shown in FIG. 6, with further forward movement of the assembly raising the panel D to its proper position, which is shown in FIG. 8, the lower edge of the panel D and the folded holddown tab HT riding up on the tongue 38 to a position on top of the support plate 36. During this movement the one bottom wall forming panel LF rides up on the top edge of a vertically disposed plow member 42 which is arranged beneath the support plate 36 to fold the panel LF into the horizontal position. Further advance of the carton and bottle assembly by the chains 25, 25′ carries the same over a plow 43 arranged to engage the bottom wall panel LM and fold it into position for locking. The assembly advances between a pair of transversely spaced conveyors operating in a horizontal plane and carrying compression fingers 44, 44′ (FIG. 8) which engage in apertures EH, CH and draw the bottom panels tight in the same manner as the compression fingers in Pat. No. 3,474,590, dated Oct. 28, 1969. Thereafter, the assembly is advanced over a latching mechanism indicated at 45 which may be fixed plow members shown in U.S. Pat. No. 2,986,857, dated June 6, 1961, arranged to engage the bottom wall forming panels and fold the locking panel LP2 so as to engage the locking and latching elements in the co-operating openings in the panel LF.

Mechanism for folding the top wall forming flaps or panels UF and UM and for tightening the same is illustrated in FIGS. 2, 4, 5, 6, 8 to 14. An elongate back up bar member 50 is suspended from the cross frame 20 by bracket 52 so as to extend between the neck portions of the two rows of bottles C (FIG. 4) as they advance. A plow member 53 is mounted by means of a depending bracket 54 on the cross frame 20 with an inwardly tapered and downwardly turned edge 55 for folding down the male panel UF, the bottles being steadied by the back up bar 50. As the carton advances to bring the panel UF into contact with the folding blade edge 55, the assembly moves between a pair of laterally spaced, endless chain conveyor assemblies 56 and 56′ (FIG. 2) which are arranged for operation in a common horizontal plane with transversely spaced, opposed runs between which the carton and bottle assemblies advance, and which are supported so as to provide a funnel-like entrance end adjacent the cross frame 20. Chain assemblies 56 and 56′ have sets of outwardly directed finger members 57 and 57′ (FIGS. 2, 4, 5, 6 and 8 to 10) spaced along their length, which are arranged for co-operation in engaging and holding the panel members UM and UF on opposite sides of the path of travel of the carton and bottle assemblies, with the panel UM being folded into wall forming position by the fingers 57 following the folding down of the co-operating panel UF by the plow member 53. The panel engaging finger members 57 and 57′ are of identical construction except as noted hereinafter. They are formed of flat plate material with horizontal and vertical legs 58, 59 and 58′, 59′ in right angle relation. The horizontal legs 58, 58′ are tapered to a relatively thin end and are adapted to move in a horizontal path so as to engage the panels UM, UF and move them into top wall forming position, as shown in FIG. 8, except for the lock and latch element bearing panel LP1 which hinges on the line LC8 into an upstanding position by engagement with a longitudinally extending plate member 60. The plate member 60 is supported in a vertical plane by bracket or cross frame member 62 from which it depends. The conveyor chain assembly 56 is supported on a series of spaced sprockets 63, 64, 65, 66, 67 and 68 which are arranged as shown in FIG. 3 and carried on parallel vertical shafts 70, 71, 72, 73, 74 and 75 which are suitably supported on the machine frame members. The chain 56′ is supported in a like manner with corresponding sprockets and shafts indicated by the same numerals primed, with the same being positioned so as to provide a funnel-like entrance between the two opposed runs of the conveyors which are spaced a predetermined distance apart. The arrangement of the opposed conveyor chain runs and the spacing of the panel engaging finger members 57 and 57′ is such that the latter co-operate in holding the panels UM and UF in tight top wall forming position as shown in FIG. 8 while the assemblies are advanced beneath a panel locking and latching mechanism indicated at 76. One of the clamp forming finger members 57' of each group thereof is provided with a short pin 77 (FIGS. 12 to 14) projecting from the vertical leg 59' which is adapted to engage in the hole PH of the panel S1 at the leading edge thereof so as to orient and square up the top of the carton.

The panel locking and latching devices indicated at 76 comprise a fixed position plow member 78 (FIG. 8) which is in the form of a plate disposed in a horizontal plane on the bottom edge of a depending support member 80 the edge of which the upstanding panel LP1 engages so that the panel LP1 is swung back or outwardly on the hinge line LC8 and past the vertical position in order to insure that the primary locking elements PL are directed into the proper locking apertures PLA in the panel UF as shown in FIG. 8.

As the assembly advances the panel LP1 is engaged by the transversely slanted edge 81 (FIG. 9) of a horizontally disposed plate member 82 which is mounted on the bottom edge of a depending frame portion constituting a support member 83 which may be an extension of support member 80. A fold forming rod 84 runs longitudinally, in generally parallel relation along the support member 83 (FIGS. 9 and 10) which is spaced laterally so as to engage the panel LP1 along the hinge line LC9 (FIG. 16) at the base of the secondary lock or latch members SL. As the panel LP1 advances between the plow forming plate member 82 and the rod or bar 84 it moves beneath a tail piece 85 (FIGS. 1, 2, 10 and 11) which is in the form of an elongate rectangular block disposed longitudinally above the path of the package assemblies and mounted on the support structure 62. The tail piece 85 has its bottom face tapered so as to slant downwardly and forwardly and also grooved or rabbited, as shown in FIGS. 1, 10 and 11, so as to provide a longitudinally disposed flange portion 87 extending along one edge of the block member 85 and depending from the forwardly inclined bottom surface 88 in laterally spaced relation along the rod member 84. The arrangement serves to turn down over the rod 84 the secondary locking members SL and direct them into the locking apertures SLA in the panel UF. The end of the horizontal leg of the finger members 57 serves as a guide disposed at the edges of the apertures SLA. The surface 88 is spaced above the fold forming rod 84 which in turn is spaced the proper distance above the top face of the panel UF to allow the fingers SL to enter the apertures PLA as the assembly reaches the forward end of the fold forming or crease breaking rod 84. The rod 84 terminates a short distance under the member 85 and the taper on the surface 88 lowers the latter or cams it down as the assembly advances so as to force the panel LP1 into final position which is accomplished as the assemblies advance under a suitably supported final pressure applying cross roller or tucking roller 90 at the end of the support frame 83.

The operation of the apparatus will be generally understood from the foregoing description of the details thereof. The cartons are generally supplied in collapsed or flattened condition so as to be fed from a magazine or other supply source, opened and lowered onto an assembly of bottles which are advancing on the conveyor 12. The carton and bottle assemblies are then advanced by the conveyor 12 to the top and bottom wall panel closing and latching mechanisms disposed at

14, elements of which are arranged above and below the path of advance of the cartons. The bottom wall forming panels LM and LF are plowed to closed position, with provision, as shown in FIGS. 2, 5, 6 and 8, for folding the holddown tab HT on an internal vertical bottle divider D and raising the divider panel D and associated tab HT into proper position, by means of fixed blades 38, 41. The carton and bottle assemblies are advanced by the side chains 25, 25' while top wall panel engaging and fold down members carried on traveling side chain assemblies 56 and 56' position and hold the top wall panels UF, UM for latching by the overhead latching or locking mechanism 76. Fixed plow mechanism is provided beneath the path for latching the bottom wall forming panels LF and LM which have been plowed to the closed position. The travel of the cartons is continuous from the entrance end through the top and bottom panel closing apparatus.

I claim:

1. An apparatus for closing filled bottle cartons wherein the cartons comprise connected side and end wall forming panels enclosing an assembly of bottles in double row arrangement with top and bottom wall forming closure panels hingedly connected to top and bottom edges of said side wall forming panels, said top wall forming closure panels having free marginal portions which are adapted to be overlapped in the plane of the top wall and which have interengaging locking means, said apparatus comprising conveyor means for supporting the bottle assemblies with the carton top wall forming panels in upstanding open relation while advancing them along a predetermined path, endless traveling conveyor means disposed for movement in horizontal planes and having opposed runs extending in spaced relation on opposite sides of said path, which conveyor means carries top wall panel engaging means, said top wall panel engaging means extending into the path of said upstanding top wall forming closure panels and engaging said panels so as to fold said panels down into top wall forming position with free marginal portions of said panels overlapped, said top wall panel engaging means comprising a series of conveyor carried plate members having angularly related face portions positioned for engaging said top wall and said side wall panels, respectively, in areas adjacent the hinge connections between the top wall forming panels and the side wall forming panels while traveling along said opposed runs, the topmost one of said plate portions being positioned to strike the upstanding top wall closure panel above the hinged connection thereof with the associated side wall panel and the lowermost one being positioned to engage the top marginal portions of the side wall and urge the same in the direction inwardly of the carton, and holding said panels in tight relation on the bottles while the carton is advanced and plow forming devices disposed at fixed points along the top of said run which interengage said panel locking means while said top wall and side wall panels are held in tight relation on the bottles.

2. An apparatus as set forth in claim 1 wherein certain of said plate members include downwardly extending face portions which are positioned in vertical planes and means on said face portions for engaging the side wall so as to orient and square up the top of the carton.

3. In an apparatus as set forth in claim 1 wherein certain of said plate members include downwardly extending face portions on one of which there is mounted a projecting pin member adapted to engage in an aperture provided in the associated carton side wall for orienting and squaring up the top of the carton.

4. An apparatus for closing and securing the closure panels of bottle cartons which enclose an assembly of bottles in upright relation wherein the cartons are characterized by hingedly connected side and end wall forming panels disposed in vertical planes, with top and bottom wall forming closure panels extending in hinged relation to the top and bottom edges of said side wall forming panels and in generally vertical planes, which top wall forming closure panels have free marginal portions which are adapted to be overlapped and which have cooperating locking means in the form of apertures in one panel and a hinged locking flap in the other panel, said locking flap having primary and secondary locking tabs and fingers adapted to be swung into engagement in said apertures, said apparatus comprising means for supporting the bottle assemblies with associated cartons thereon while advancing them along a predetermined horizontal path, endless traveling conveyor means disposed in horizontal planes and having opposed runs extending in spaced relation on opposite sides of said path and above said supporting means for said bottle assemblies, and top wall panel engaging means on said traveling conveyor means which advances into the path of said upstanding top wall forming closure panels and which engages said panels as they are folded down into top wall forming position so as to exert sufficient downward and inward force to hold said panels in tight relation while the carton is advanced, and mechanism disposed above the path of said bottle assembly and carton supporting means for folding said locking flap and engaging said locking tabs and fingers in said apertures while said top wall forming panels are held in tight relation on said bottle assemblies.

5. An apparatus as set forth in claim 4 wherein said top wall engaging means comprises a series of conveyor carried angularly related plate members having top portions which are mounted to travel inwardly in a horizontal plane and progressively engage upstanding top wall forming panels above the hinged connection thereof with the side walls as said panels are folded inwardly in succession into wall forming relation with the margins overlapping, while advancing with the containers.

6. An apparatus as set forth in claim 5 wherein said angularly related plate members are positioned on the conveyors and the conveyors are arranged so that said top portions will strike the top wall closure panels above the hinge connection line and adjoining downwardly extending portions will engage top marginal portions of side wall panels and urge the same inwardly of the carton.

7. An apparatus as set forth in claim 6 wherein said angularly related plate members include downwardly extending face portions which are in vertical planes and which have means thereon for engaging portions of the cartons so as to cooperate in squaring up the top of each carton.

8. An apparatus as set forth in claim 4 wherein said means for holding said panels in tight relation is in the form of plate-like fingers with certain of said fingers mounted so as to move in a path to engage and fold a top closure panel into margin overlapping relation with a co-operating top closure panel.

9. An apparatus as set forth in claim 8 wherein said mechanism for folding said locking flap and engaging said tabs and fingers in said apertures comprises longitudinally spaced fixed plow members positioned along the path of advance of said cartons for successive engagement by each locking flap so as to swing the locking flap to first insert the primary locking tabs in said apertures and thereafter to guide the associated locking fingers into said apertures.

10. An apparatus as set forth in claim 8 wherein said mechanism for folding said locking flap and engaging said tabs and fingers in said apertures comprises spaced plow forming members disposed along the path of said cartons for successive engagement by each locking flap which members include co-operating plate and rod members positioned above the carton path so as to hinge said locking flap and said fingers for insertion of said tabs and fingers into the co-operating locking apertures.

11. An apparatus as set forth in claim 4 wherein said mechanism for folding said locking flaps and engaging said tabs and fingers in said apertures comprises plate and rod members disposed in spaced relation above said carton path so as to be engaged by said locking flap for hinging said flap and fingers to a position for insertion of said tabs and fingers into the co-operating locking apertures and means for applying pressure downward upon said locking flap so as to seat said tabs and fingers in said apertures.

12. An apparatus as set forth in claim 11 wherein said means for applying downward pressure on said locking flaps comprises an elongate block member having a bottom face tapering forwardly and downwardly beneath which the locking flaps advance and a guide flange extending along one edge so as to guide said fingers into said apertures.

13. An apparatus for closing and securing the closure panels of filled bottle cartons wherein the cartons are characterized by hingedly connected side and end wall forming panels, with top and bottom wall forming closure panels hinged to the top and bottom edges of said side wall forming panels, which top wall forming closure panels have free marginal portions which are adapted to be overlapped and which have co-operating locking means in the form of apertures in one panel and a hinged locking flap in the other panel which has primary and secondary locking tabs and fingers adapted to be swung into engagement in said apertures, said apparatus comprising means for supporting the filled cartons while advancing them along a predetermined horizontal path, endless traveling conveyor means disposed in horizontal planes and having opposed runs extending in spaced relation on opposite sides of said path, and top wall panel engaging means on said traveling conveyor means which advances into the path of said upstanding top wall forming closure panels and which engages said panels as they are folded down into top wall forming position so as to hold said panels in tight relation while the carton is advanced along mechanism for folding said locking flap and engaging said locking tabs and fingers in said apertures, said top wall engaging means comprising a series of conveyor carried, angularly related plate members having top portions which are mounted to travel in a horizontal plane and engage upstanding top wall forming panels above the hinged connection thereof with the side walls as said panels are folded inwardly into top wall forming relation with the margins overlapping, said angularly related plate members being positioned on the conveyors and the conveyors being arranged so that said top portions will strike the top wall closure panels above said hinged connection line and adjoining, downwardly extending, face forming portions which are in vertical planes will engage top marginal portions of side wall panels and urge the same inwardly of the carton, and on one of which face forming portions there is mounted a pin forming member positioned to engage in an aperture provided in a carton side wall for positioning and squaring up the top of the carton.

14. In an apparatus for opening collapsed cartons and filling and closing said cartons wherein the cartons comprise hingedly connected side and end wall forming panels with top and bottom wall forming closure panels hinged to top and bottom edges of said wall forming panels, which bottom wall forming closure panels have free marginal portions which are adapted to be overlapped and which have interengaging locking means, mechanism for closing said top wall forming panels which comprises means for supporting the cartons while advancing them along a predetermined path, endless traveling conveyor means disposed in horizontal planes and having opposed runs extending in spaced relation on opposite sides of said path, and a series of plate members carried on said conveyor means having angularly related face portions positioned for engaging said top wall and said side wall forming panels, respectively, in areas adjacent the hinge connections between the top wall forming panels and the side wall forming panels while traveling along said opposed conveyor runs, said plate members being mounted to travel inwardly in a horizontal plane and having topmost portions positioned to progressively strike upstanding portions of said top wall forming panels above the hinged connections thereof with the associated side wall forming panels and having bottommost portions positioned to engage the top marginal portions of the side wall forming panels so as to progressively fold said top wall forming panels down into top wall forming position with marginal portions overlapping and to urge said side wall forming panels inwardly of the carton thereby to hold said panels in tight relation while the carton is advanced, and plow forming means disposed at fixed points along said path for interengaging said panel locking means while said top wall forming and said side wall forming panels are held in tight relation by said plate members.

15. In an apparatus for closing bottom wall forming panels on a bottle carton having a double row of bottles therein together with an internal bottle divider panel on the bottom edge of which there is a hingedly connected, downwardly projecting divider hold down tab, means for supporting and advancing said carton with the bottles and divider panel therein and with bottom closure panels depending from the bottom edge of side wall panels along a predetermined path, a tongue member depending below the bottle supporting means in the path of said divider hold down tab which tongue member provides an upwardly directed surface forming a ramp which merges into the top surface of the bottle supporting means and a hinge breaking plate member disposed in the path of said hold down tab with an edge positioned to engage said tab at its hinge connecting point whereby when the assembly of carton and bottles is advanced along said tongue member said divider hold down tab is swung into a horizontal position and said divider panel is raised by said ramp so as to bring said hold down tab into engagement with the bottom face of a bottle.

16. In an apparatus as set forth in claim 15 wherein means in the form of plow members are provided for folding the carton bottom closure panels sequentially so as to position them in bottom closing position and to trap said divider hold down tab between the bottom of a bottle and a bottom wall panel.

17. In an apparatus for opening collapsed cartons and filling and closing said cartons wherein the cartons comprise hingedly connected side and end wall forming panels with top and bottom wall forming closure panels hinged to top and bottom edges of said side wall forming panels, which bottom wall forming closure panels have free marginal portions which are adapted to be overlapped and which have interengaging locking means, mechanism for closing said top wall forming panels which comprises means for supporting the cartons while advancing them along a predetermined path, endless traveling conveyor means disposed in horizontal planes and having opposed runs extending in spaced relation on opposite sides of said path, and a series of angularly related plate members carried by said endless traveling conveyor means and having top portions which are mounted to travel in a horizontal plane and engage said upstanding top wall forming panels above the hinged connection thereof with the side walls so as to fold said panels inwardly in succession and into wall forming relation with the margins overlapping and hold said panels in tight relation while the carton is advanced along mechanism for interengaging said panel locking means, said angularly related plate members being positioned on said associated conveyors so that said top portions will strike the top wall closure panels above the hinge connection line and associated downwardly extending face portions will engage top marginal portions of side wall panels and urge the same inwardly of the carton and said angularly related plate members include downwardly extending face portions on one of which there is mounted a projecting pin member adapted to engage in an aperture provided in the associated carton side wall for orienting and squaring up the top of the carton.

* * * * *